US005306883A

United States Patent [19]

Manandhar et al.

[11] Patent Number: 5,306,883

[45] Date of Patent: Apr. 26, 1994

[54] DECELERATION SENSOR SWITCH FOR USE IN A VEHICLE OCCUPANT SAFETY SYSTEM

[75] Inventors: Saroj Manandhar, Chino Hills; Robert J. Bolender, Pasadena; James Purves, Alta Loma; Long T. Su, West Covina, all of Calif.

[73] Assignee: TRW Technar Inc., Irwindale, Calif.

[21] Appl. No.: 36,482

[22] Filed: Mar. 24, 1993

[51] Int. Cl.[5] ..... H01H 35/14

[52] U.S. Cl. ..... 200/61.53

[58] Field of Search ..... 200/61.45 R, 61.45 M, 200/61.53

[56] References Cited

U.S. PATENT DOCUMENTS

| | | | |
|---|---|---|---|
| 2,984,719 | 5/1961 | Higgs et al. | 200/83 C |
| 3,549,169 | 12/1970 | Oldberg et al. | 280/735 |
| 3,571,539 | 3/1971 | Kaiser et al. | 200/61.53 |
| 3,662,606 | 5/1972 | Prachar | 73/514 |
| 3,832,507 | 8/1974 | Marquardt et al. | 200/61.45 R |
| 4,184,057 | 1/1980 | Kumita et al. | 200/61.45 R |
| 5,053,588 | 10/1991 | Bolender | 200/61.45 R |
| 5,066,837 | 11/1991 | Gunning et al. | 200/61.45 R |
| 5,153,393 | 10/1992 | Breed et al. | 200/61.45 R |
| 5,206,469 | 4/1993 | Takeda et al. | 200/61.45 M |

OTHER PUBLICATIONS

Article entitled "Crash Sensors for Inflatable Occupant Restraint Systems", by E. Pujdowski, Eaton Corp.-Safety Systems Div., 2nd International Conference on Passive Restraints, Detroit, Michigan, May 22-25, 1972.

*Primary Examiner*—J. R. Scott

*Attorney, Agent, or Firm*—Tarolli, Sundheim & Covell

[57] ABSTRACT

A deceleration sensor switch comprises a base including a plate portion, a pedestal portion projecting from the plate portion, and a rod portion spaced from the plate portion and projecting from the pedestal portion. The plate, pedestal, and rod portions comprise a single continuous piece of plastic molded material. A mass is mounted on the rod portion and is movable relative to the rod portion between an unactuated position and an actuated position. The mass moves from the unactuated position to the actuated position when the mass is subjected to deceleration of a predetermined magnitude. A helical coil spring provides a restoring force which acts on the mass to move the mass relative to the rod portion from the actuated position back to the unactuated position after the mass has moved to the actuated position. An adjustable calibration screw is disposed at one end of the rod portion. The calibration screw is adjusted to adjust the restoring force of the helical coil spring acting on the mass.

22 Claims, 4 Drawing Sheets

DECELERATION SENSOR SWITCH FOR USE IN A VEHICLE OCCUPANT SAFETY SYSTEM

BACKGROUND OF THE INVENTION

1. Technical Field

The present invention relates to a deceleration sensor switch, and is particularly directed to a deceleration sensor switch comprising an inertia mass which moves against a spring bias in response to a predetermined deceleration.

2. Background Art

Deceleration sensor switches which include an inertia mass which moves against a spring bias in response to a predetermined deceleration are known. One known deceleration sensor switch includes a donut-shaped inertial mass slidable on a rod against a spring bias. Another known deceleration sensor switch includes a mass disposed in a cylindrical chamber in a body and movable in the chamber against a spring bias. Also, some of the known deceleration sensor switches have means for adjusting the spring bias to adjust the responsiveness of the deceleration sensor switch.

SUMMARY OF THE INVENTION

In accordance with the present invention, a deceleration sensor switch comprises a base including a plate portion, a pedestal portion projecting from the plate portion, and a rod portion spaced from the plate portion and projecting from the pedestal portion. The plate portion lies in a flat plane and the rod portion has a longitudinal central axis which extends parallel to the flat plane in which the plate portion lies. The plate, pedestal, and rod portions comprise a single continuous piece of molded plastic material.

A mass is mounted on the rod portion and is movable relative to the rod portion between an unactuated position and an actuated position along the longitudinal central axis of the rod portion. The mass moves from the unactuated position to the actuated position when the deceleration sensor switch is subjected to deceleration of a predetermined magnitude. First and second electrical terminals are electrically connectable with each other. Means is provided for electrically connecting the first and second electrical terminals with each other when the mass moves from the unactuated position to the actuated position.

The mass moves against a spring bias to provide a restoring force which acts on the mass to move the mass relative to the rod portion from the actuated position back to the unactuated position. The spring bias is provided by a helical coil spring helically wound around the rod portion along its longitudinal central axis.

Means is disposed at one end of the rod portion for adjusting the bias of the spring acting on the mass. The means disposed at one end of the rod portion includes an adjustable calibration screw which acts on the spring. By rotating the calibration screw clockwise or counterclockwise, the screw moves relative to the rod portion to adjust the bias of the spring acting on the mass.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF PREFERRED EMBODIMENTS

Figure 1:
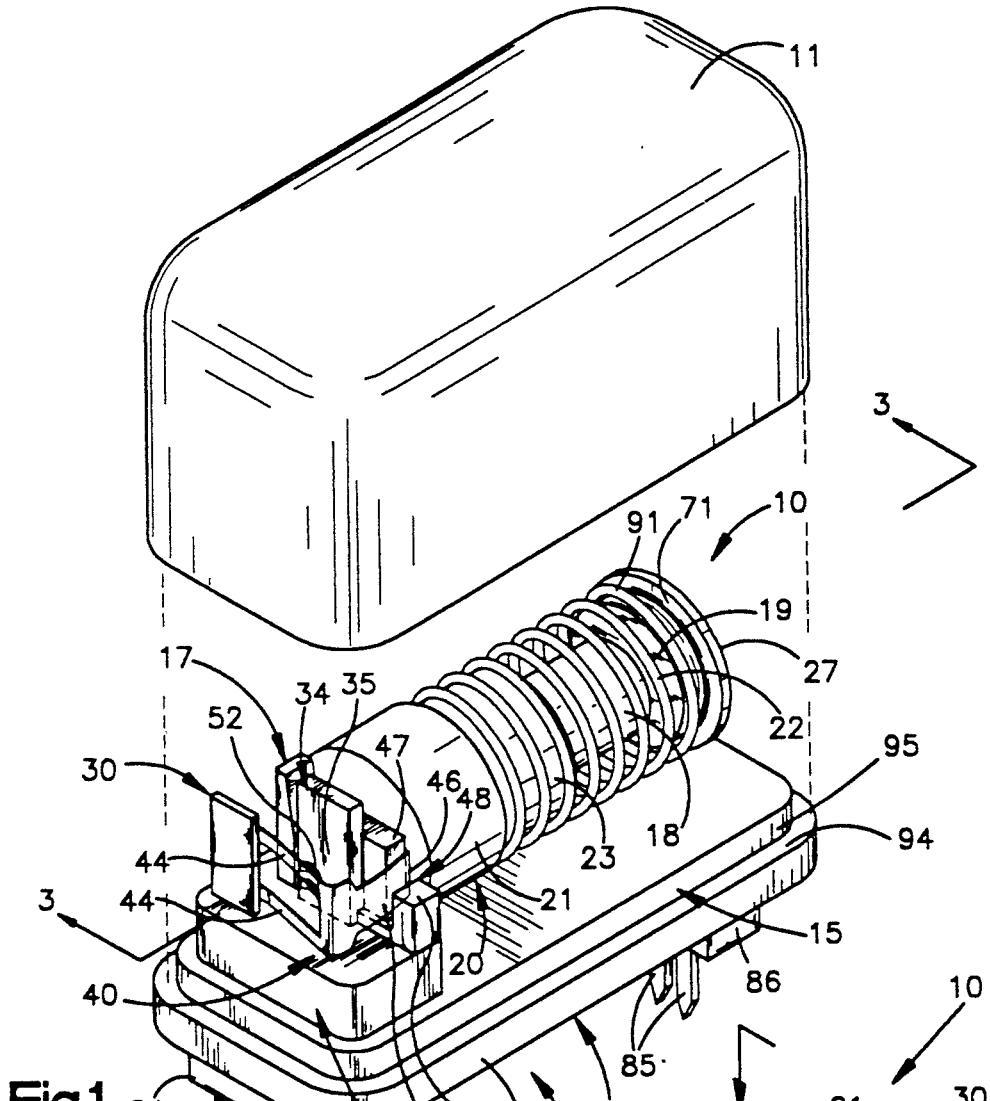
FIG. 1 is a perspective view of a deceleration sensor switch constructed in accordance with the present invention and looking at the switch at a given angle.

The present invention is directed to a deceleration sensor switch comprising a mass which moves against a spring bias. A deceleration sensor switch in accordance with the present invention may be used in a variety of different systems. Preferably, the deceleration sensor switch is used in a vehicle occupant safety system, such as an air bag system, to trigger inflation of an air bag in the event of vehicle deceleration indicative of a vehicle collision. A deceleration sensor switch 10 constructed in accordance with the present invention is shown in FIG. 1.

The deceleration sensor switch 10 comprises a base 12. The base 12 includes a bottom plate portion 14 and a top plate portion 15 located above the bottom plate portion 14. The bottom plate portion 14 lies in a flat plane. The top plate portion 15 lies in another flat plane which is parallel to the flat plane in which the bottom plate portion 14 lies. The bottom plate portion 14 has a main body part 82, a first terminal support part 84 located adjacent one end of the main body part 82, and a second terminal support part 86 located adjacent an opposite end of the main body part 82. The first and second terminal support parts 84, 86 project away from the main body part 82.

Figure 2:
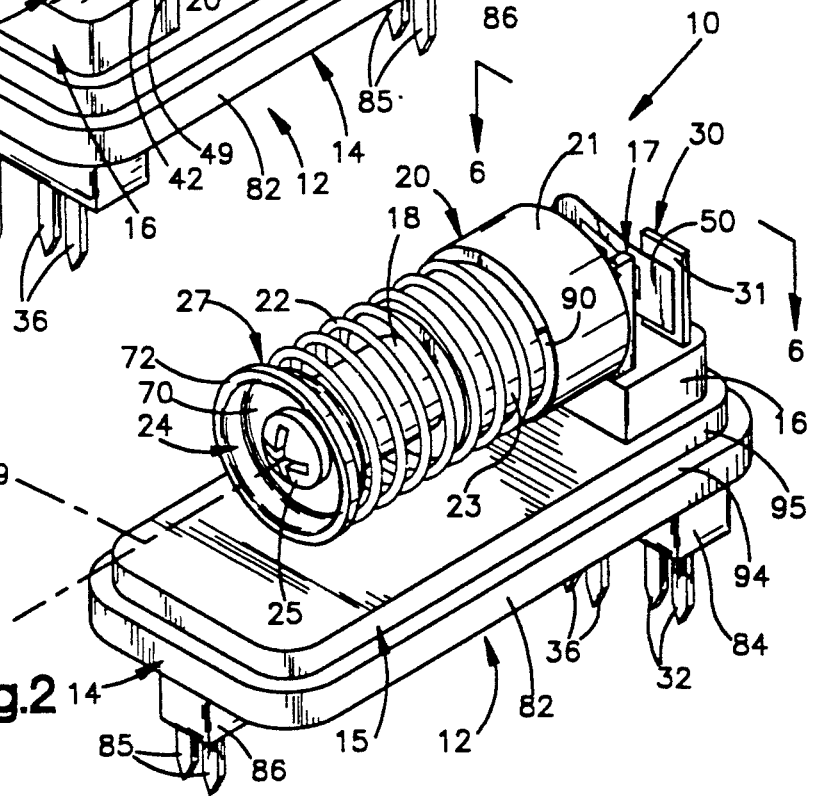
FIG. 2 is another perspective view of the deceleration sensor switch of FIG. 1 and looking at the switch at a different angle.

As shown in FIGS. 1 and 2, the bottom plate portion 14 is larger than the top plate portion 15. The top plate portion 15 overlies part of the bottom plate portion 14 in such a way that a ledge 94 of uniform width is formed around the outer periphery of the base 12. The top plate portion 15 has a side wall 95 which extends around the outer periphery of the top plate portion 15. The side wall 95 extends perpendicular to the ledge 94. A cover 11 (shown only in FIG. 1) is sealingly engageable against the side wall 95 of the top plate portion 15 and the ledge 94 of the bottom plate portion 14 to seal and protect the deceleration sensor switch 10.

The base 12 further includes a horizontal pedestal portion 16 located above the top plate portion 15 and a vertical pedestal portion 17 located above the horizontal pedestal portion 16. The horizontal pedestal portion 16 overlies part of the top plate portion 15 and the vertical pedestal portion 17 projects perpendicularly away from the horizontal pedestal portion 16. The vertical pedestal portion 17 has a first vertically projecting part 47 and a second vertically projecting part 49 which is smaller than the first vertically projecting part 47. A vertically extending slot 48 is defined between the first and second vertically projecting parts 47, 49 of the vertical pedestal portion 17.

Figure 3:
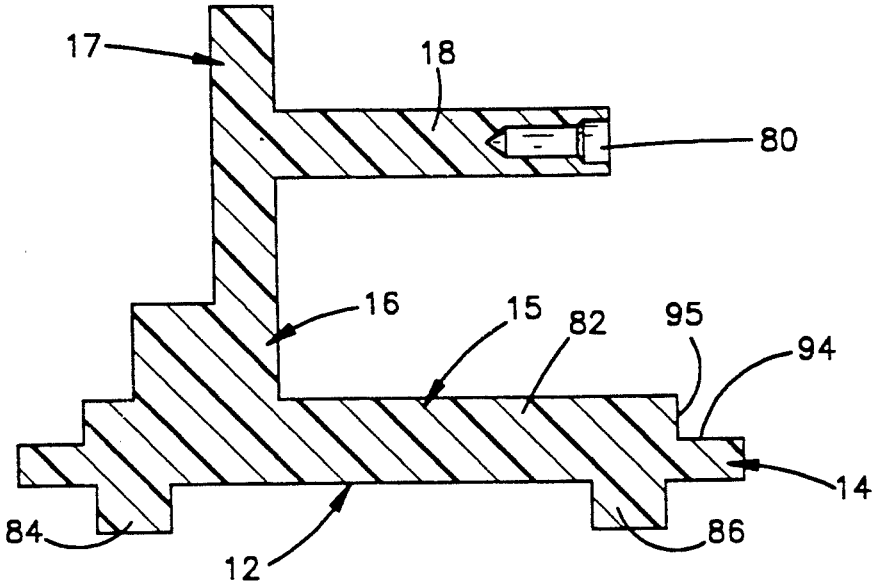
FIG. 3 is a sectional view, taken approximately along line 3—3 of FIG. 1 and with parts removed, showing a base of the deceleration sensor switch of FIG. 1.

The base 12 further includes a tubular rod portion 18 spaced from the top plate portion 15 and cantilevered from the vertical pedestal portion 17. The rod portion 18 has a free end 19 (FIG. 1) and a longitudinal central axis 99 (FIG. 2) which extends parallel to the flat planes in which the top and bottom plate portions 14, 15 lie. The rod portion 18, the horizontal and vertical pedestal portions 16, 17, and the top and bottom plate portions 14, 15 are a single continuous piece of molded plastic material, as best shown in the sectional view of FIG. 3.

Figure 6:
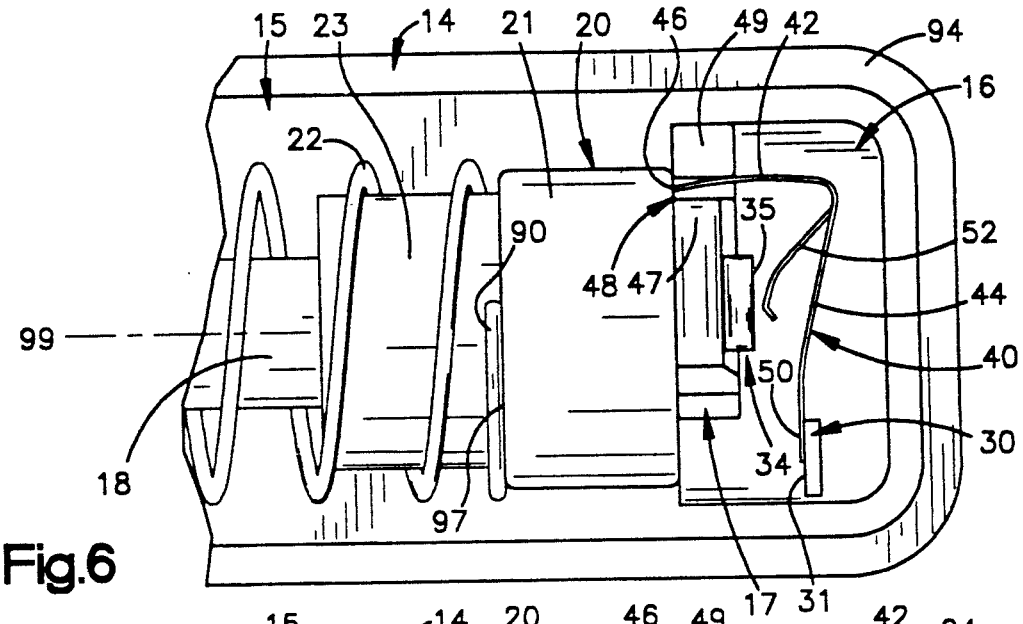
FIG. 6 is an enlarged view of a portion of the deceleration sensor switch of FIG. 2 as viewed in the direction along line 6—6 in FIG. 2.
Figure 8:
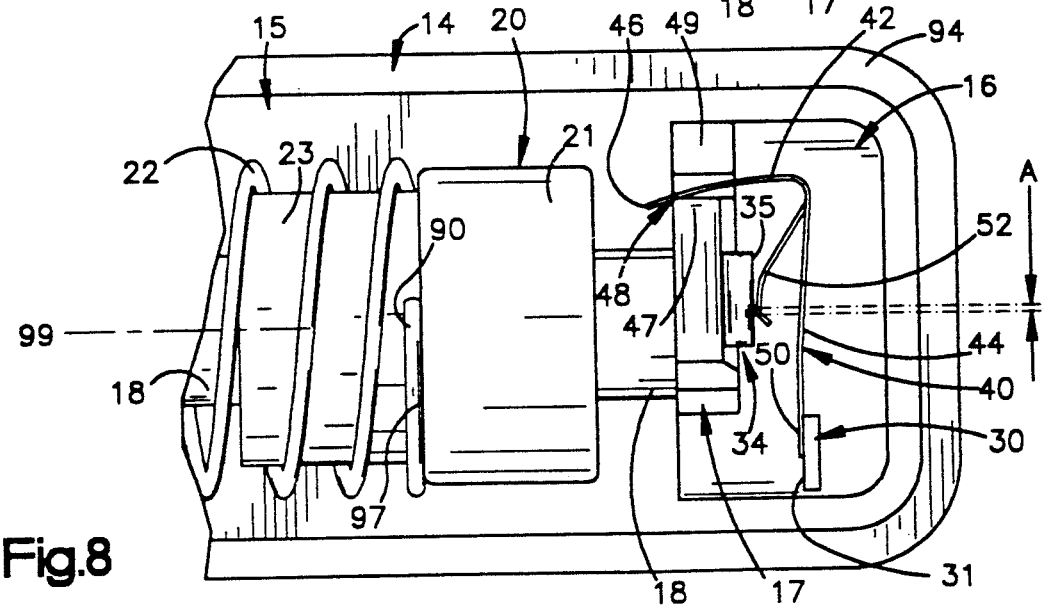
FIG. 8 is a view similar to FIG. 7 but showing parts of the deceleration sensor switch in still other positions.

A mass 20 is mounted on the rod portion 18 and is movable relative to the rod portion 18 between an unactuated position shown in FIG. 6 and an actuated position shown in FIG. 8 along the longitudinal central axis 99 of the rod portion 18. The mass 20 has a first ring-like portion 21 having a cross-sectional outer diameter and a second ring-like pilot portion 23 having a cross-sectional outer diameter smaller than the cross-sectional outer diameter of the first ring-like portion 21. The first and second ring-like portions 21, 23 are coaxial.

A spring 22 in the form of a helical coil spring is helically wound around the rod portion 18 along its longitudinal central axis 99. The spring 22 has one end 90 (FIG. 2) and another end 91 (FIG. 1) located opposite the one end 90. The second ring-like pilot portion 23 of the mass 20 extends into the end 90 of the spring 22 to support and guide the spring 22. The end 90 of the spring 22 abuts against a ring-shaped surface 97 (FIG. 6) at one end of the first portion 21 of the mass 20. The spring bias of the spring 22 presses against the ring-shaped surface 97 of the first portion 21 of the mass 20 to press the mass 20 into engagement with the vertical pedestal portion 17.

As shown in FIG. 2, an adjustable calibration member 24 in the form of a threaded screw having a head portion 25 is screwed into the free end 19 of the rod portion 18. The rod portion 18 has a cylindrical hole 80 (shown only in FIG. 3) in which the threads of the threaded screw 24 engage. A washer 27 is located between the head portion 25 of the threaded screw 24 and the free end 19 of the rod portion 18.

Figure 4:
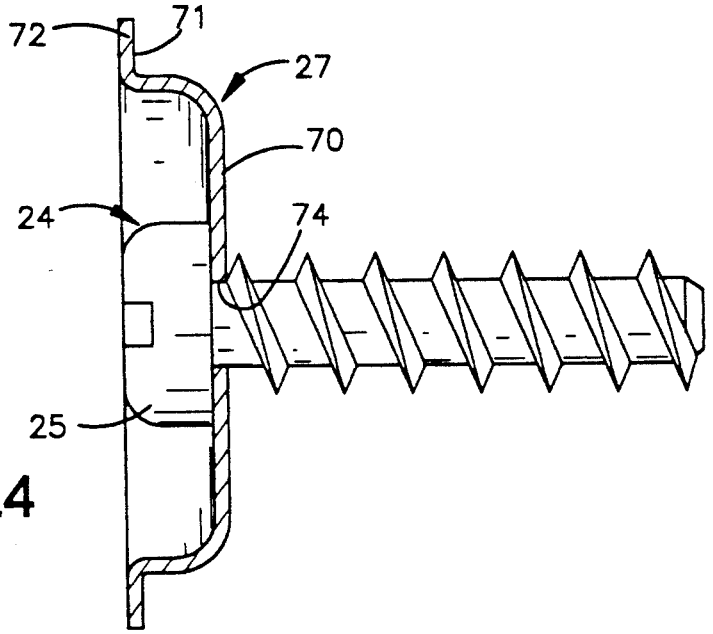
FIG. 4 is an enlarged view of a disc-shaped washer used in the deceleration sensor switch of FIG. 1.

As shown in enlarged detail in FIG. 4, the washer 27 includes a ring-like pilot portion 70 and a ring-like flange portion 72 extending from the ring-like pilot portion 70. The ring-like portions 70, 72 are coaxial. The ring-like pilot portion 70 of the washer 27 extends into the end 91 of the spring 22 to support and guide the spring 22. The end 91 of the spring 22 abuts against a ring-shaped surface 71 (FIG. 4) on the ring-like flange portion 72 of the washer 27. The spring bias of the spring 22 presses against the ring-shaped surface 71 of the ring-like flange portion 72 of the washer 27 to press the washer 27 into engagement with the head portion 25 of the threaded screw 24. The threaded screw 24 is received in a hole 74 (FIG. 4) which extends through the ring-like pilot portion 70 of the washer 27.

The threaded screw 24 can be rotated clockwise or counterclockwise to either move the washer 27 towards the free end 19 of the rod portion 18 or to allow the washer 27 to move away from the free end 19 of the rod portion 18 due to the spring bias of the spring 22 acting on the washer 27. Therefore, the position of the washer 27 relative to the free end 19 of the rod portion 18 can be adjusted by rotating the threaded screw 24 clockwise or counterclockwise. The spring bias of the spring 22 acting on the mass 20 depends upon the position of the washer 27 relative to the free end 19 of the rod portion 18. Thus, the spring bias of the spring 22 acting on the mass 20 can be adjusted by rotating the threaded screw 24 either clockwise or counterclockwise.

A terminal 30 made of a suitable electrical current conducting material, preferably stainless steel, is insert molded into the horizontal pedestal portion 16, the top plate portion 15, the main body part 82 of the bottom plate portion 14, and the first terminal support part 84 of the bottom plate portion 14. The terminal 30 has bifurcated leg portions 32 which extend away from the first terminal support part 84 of the bottom plate portion 14. One of the leg portions 32 is connectable to a negative terminal of a voltage supply and the other one of the leg portions 32 is connectable to an external resistor for diagnostic purposes. The end of the terminal 30 opposite the leg portions 32 is one of a pair of electrical terminals of the deceleration sensor switch 10.

Another terminal 34 also made of a suitable electrical current conducting material, preferably stainless steel, is insert molded into the horizontal pedestal portion 16, the top plate portion 15, the main body part 82 of the bottom plate portion 14, and the first terminal support part 84 of the bottom plate 14. The terminal 34 has bifurcated leg portions 36 which extend away from the first terminal support part 84 of the bottom plate portion 14. One of the leg portions 36 is connectable to a positive terminal of a voltage supply and the other one of the leg portions 36 is connectable to an external resistor for diagnostic purposes. The end of the terminal 34 opposite the leg portions 36 is the other one of the pair of electrical terminals of the deceleration sensor switch 10.

A pair of leg portions 85 are insert molded into the second terminal support part 86. The leg portions 85 extend away from the second terminal support part 86 in the same direction as the leg portions 32 of the terminal 30 and the leg portions 36 of the terminal 34 extend away from the first terminal support part 84. The three leg portions 32, 36, 85 support the deceleration sensor switch 10 when the deceleration sensor switch 10 is mounted for use.

Figure 5:
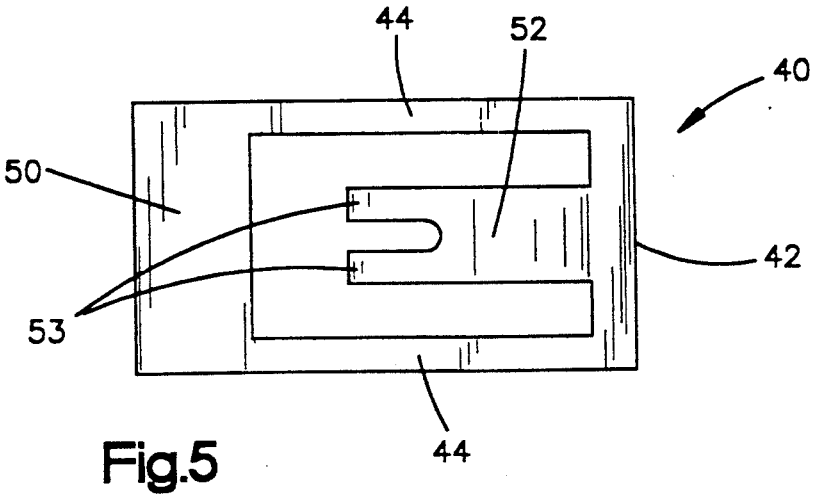
FIG. 5 is a plan view of a movable contact used in the deceleration sensor switch of FIG. 1.

As best shown in FIGS. 1, 5 and 6, a movable contact 40 made of stainless steel includes a releasable tab portion 42 and two generally parallel strip portions 44 extending from the tab portion 42. An edge 46 of the tab portion 42 extends through the vertically extending slot 48 defined between the first and second vertically projecting parts 47, 49 of the vertical pedestal portion 17. The contact 40 also includes an end portion 50 which interconnects the two parallel strip portions 44. The end portion 50 is welded to a flat surface 31 of the terminal 30 so that the two parallel strip portions 44 of the contact 40 extend horizontally, as viewed in FIG. 1. The two parallel strip portions 44 act like leaf springs to provide a spring-like force which presses the edge 46 of the tab portion 42 into contact with the first portion 21 of the mass 20.

The contact 40 also has a contact portion 52 which extends from the tab portion 42 and is located between the two parallel strip portions 44, as best shown in FIGS. 1, 5 and 6. The contact portion 52 has a pair of spring-like legs 53 (best shown in FIG. 5) which are contactable with a surface 35 (FIGS. 1 and 5) of the terminal 34. When the legs 53 of the contact portion 52 are not contacting the surface 35 of the terminal 34, the terminal 34 and the terminal 30 are not electrically connected. When the terminal 34 and the terminal 30 are not electrically connected, the deceleration sensor switch 10 is in a fully opened condition, as shown in FIG. 6. When the deceleration sensor switch 10 is in the fully opened condition shown in FIG. 6, the first portion 21 of the mass 10 abuts against the vertical pedestal portion 17 and against the edge 46 of the tab portion 42 so as to maintain the contact portion 52 spaced apart from the surface 35 of the terminal 34.

When the deceleration sensor switch 10 is subjected to deceleration of a predetermined magnitude, such as occurs in a vehicle collision, the mass 20 begins to slide along the rod portion 18 and in a direction against the bias of spring 22 to compress the spring 22. As the mass 20 begins to slide along the rod portion 18 toward the left, as viewed in FIGS. 6–8, the mass 20 moves away from the vertical pedestal portion 17 and the edge 46 of the tab portion 42.

Figure 7:
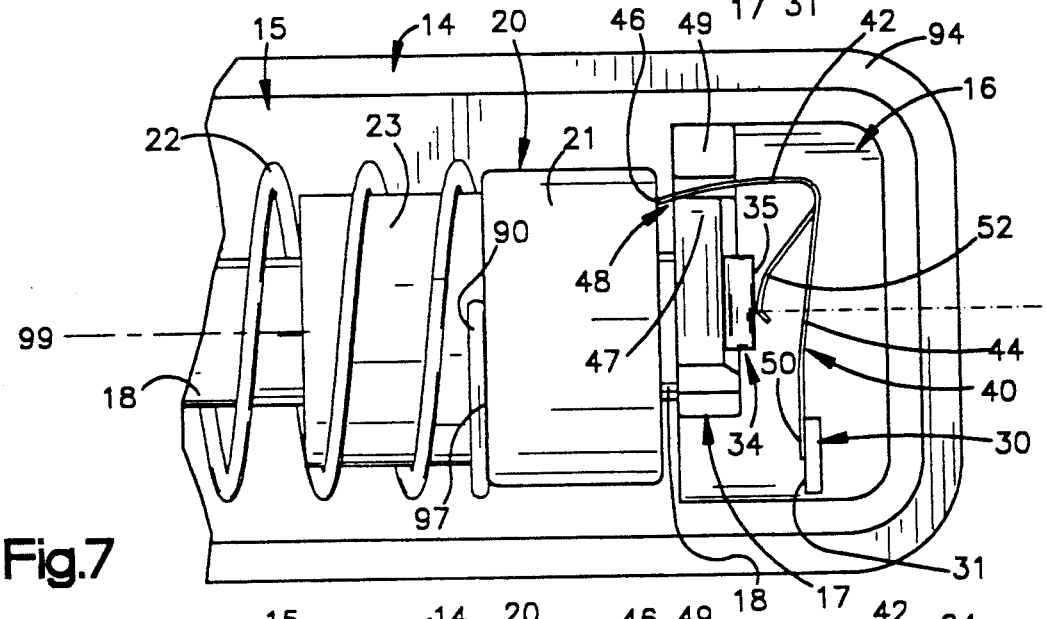
FIG. 7 is a view similar to FIG. 6 but showing parts of the deceleration sensor switch in different positions.

As the mass 20 moves away from the edge 46 of the tab portion 42, the tab portion 42 is released and slides through the slot 48 (towards the left as viewed in FIGS. 6–8) due to the spring-like force of the two parallel strip portions 44 acting on the tab portion 42. The tab portion 42 continues to slide through the slot 48 until the legs 53 of the contact portion 52 move into an initial contact position relative to the surface 35 of the terminal 34, as shown in FIG. 7, to establish initial electrical connection between the terminal 34 and the terminal 30. When the legs 53 of the contact portion 52 are in their initial contact position shown in FIG. 7 and initial electrical connection is established between the terminal 34 and the terminal 30, the deceleration sensor switch 10 is in an initial closed condition.

After the legs 53 of the contact portion 52 move into its initial contact position relative to the surface 35 of the terminal 34, as shown in FIG. 7, the mass 20 continues to move away from the edge 46 of the tab portion 42 to further compress the spring 22. As the mass 20 continues to move away from the edge 46 of the tab portion 42 to further compress the spring 22, the tab portion 42 continues to slide through the slot 48 due to the spring-like force of the two parallel strip portions 44 acting on the tab portion 42. As the tab portion 42 continues to slide through the slot 48, the legs 53 of the contact portion 52 wipe (slide) across the surface 35 of the terminal 34.

The legs 53 of the contact portion 52 continue to wipe across the surface 35 of the terminal 34 until they reach a final contact position, as shown in FIG. 8. When the legs 53 of the contact portion 52 reach the final contact position shown in FIG. 8, the tab portion 42 stops sliding through the slot 48. However, the mass 20 may continue to slide farther along the rod portion 18 and to move farther away from the edge 46 of the tab portion 42, as shown in FIG. 8, due to the deceleration forces acting on the deceleration sensor switch 10.

During their wiping movement from their initial contact position shown in FIG. 7 to their final contact position shown in FIG. 8, the legs 53 of the contact portion 52 move a certain distance, designated with reference letter A in FIG. 8, across the surface 35 of the terminal 34. The distance A is relatively small, but is shown exaggerated in FIG. 8 for purposes of illustration. Electrical contact between the terminal 34 and the terminal 30 is maintained during wiping movement of the legs 53 of the contact portion 52 from their initial contact position shown in FIG. 7 to their final contact position shown in FIG. 8. When the legs 53 of the contact portion 52 are in their final contact position shown in FIG. 8 and electrical contact is maintained between the terminal 34 and the terminal 30, the deceleration sensor 10 is in a fully closed condition.

By allowing the legs 53 of the contact portion 52 to wipe across the surface 35 of the terminal 34 as the legs 53 of the contact portion 52 move from their initial contact position shown in FIG. 7 to their final contact position shown in FIG. 8, the electrical connection between the terminal 34 and the terminal 30 is very reliable. This is because the wiping motion helps to overcome any small particles which may be present between the surface 35 of the terminal 34 and the legs 53 of the contact portion 52. Also, the wiping motion results in a rubbing action between two contact areas. This rubbing action helps to penetrate through any oxides, corrosion, or other non-conducting film which may be present on the contact areas between the surface 35 of the terminal 34 and the legs 53 of the contact portion 52.

The mass 20 begins to move from its actuated position shown in FIG. 8 back toward its unactuated position shown in FIG. 6 due to the spring bias of the spring 22 when the deceleration forces which caused the movement of the mass 20 to its actuated position dissipates. As viewed in FIG. 8, the mass 20 begins to move toward the right. The mass 20 continues to move toward the right until the first portion 21 of the mass 20 comes into initial contact with the edge 46 of the tab portion 42 of the contact 40.

After the first portion 21 of the mass 20 comes into initial contact with the edge 46 of the tab portion 42, the mass 20 continues to move to the right. As this occurs, the mass 20 presses against the edge 46 of the tab portion 42 to slide the tab portion 42 through the slot 48 (towards the right as viewed in FIGS. 6–8). The mass 20 continues to move to the right and the tab portion 42 continues to slide through the slot 48 until the legs 53 of the contact portion 52 move away from the surface 35 of the terminal 34. The mass then continues to move to the right until eventually the mass 20 reaches its unactuated position shown in FIG. 6. When the mass 20 reaches its unactuated position shown in FIG. 6, the tab portion 42 stops sliding through the slot 48 and the contact portion 52 stops moving away from the surface 35 of the terminal 34. The deceleration sensor switch 10 is thus returned to its fully opened condition, as shown in FIG. 6.

Figure 9:
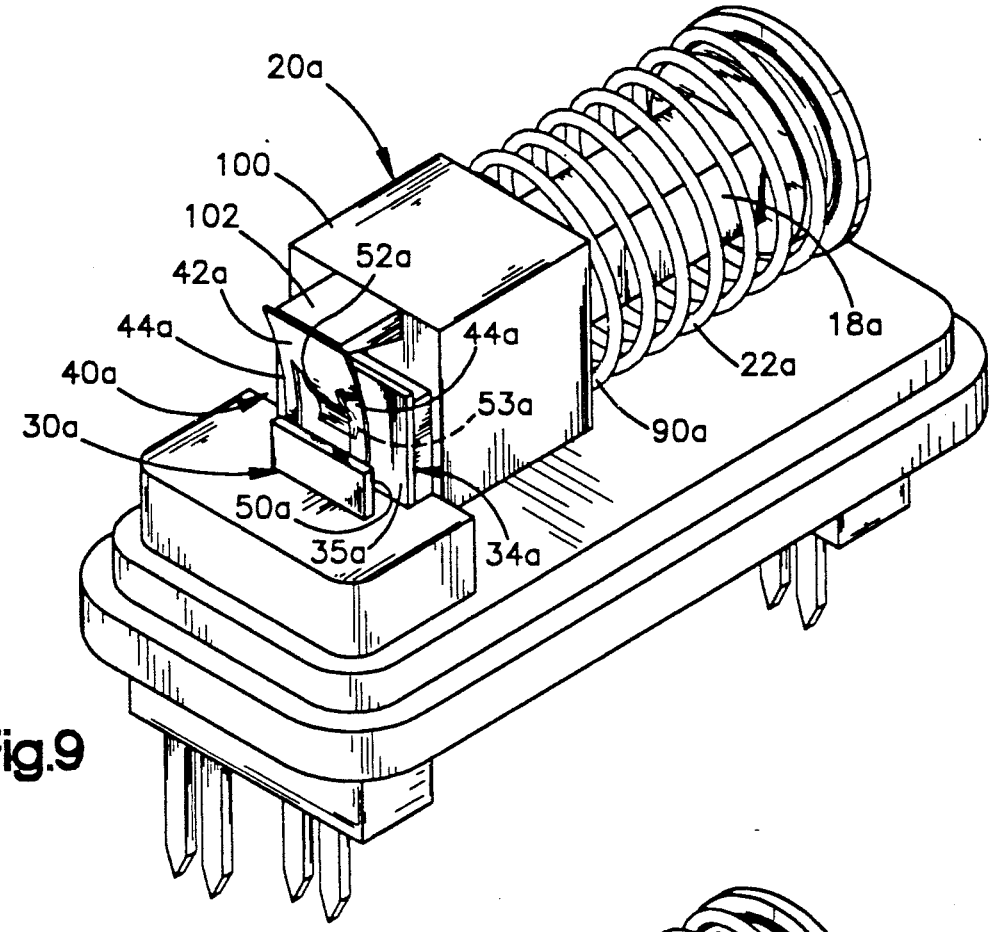
FIG. 9 is a perspective view, similar to the perspective view shown in FIG. 1, of a second embodiment of the present invention.

A second embodiment of the present invention is illustrated in FIG. 9. Since the embodiment of the invention illustrated in FIG. 9 is generally similar to the embodiment of the invention illustrated in FIG. 1, similar numerals are utilized to designate similar components, the suffix letter "a" being associated with the embodiment of FIG. 9 to avoid confusion.

The end 50*a* of the contact 40*a* is welded to the terminal 30*a* so that the two parallel strip portions 44*a* of the contact 40*a* extend vertically, as viewed in FIG. 9. Also, in the embodiment of FIG. 9, the rod 18*a* is generally rectangular in cross section and the mass 20*a* is generally rectangular in cross section. The mass 20*a* has a rectangular-shaped central opening (not shown) which has a shape complementary to the shape of the rod 18*a* and through which the rectangular-shaped rod 18*a* extends. The one end 90*a* of the spring 22*a* is received in a cylindrical hollow (also not shown) in the mass 20*a* to support and guide the spring 22*a*.

The mass 20*a* has a main portion 100 and a protruding portion 102 which extends from the main portion 100. The protruding portion 102 of the mass 20*a* engages the tab portion 42*a* of the contact 40*a* when the mass 20*a* is in its unactuated position, as shown in FIG. 9. When the protruding portion 102 engages the tab portion 42*a*, as shown in FIG. 9, the legs 53*a* of the contact portion 52*a* of the contact 40*a* are spaced apart from the surface 35*a* of the terminal 34*a*. Thus, the terminal 30*a* is not electrically connected with the terminal 34*a* when the mass 20*a* is in its unactuated position, as shown in FIG. 9.

When the mass 20*a* moves to its actuated position (not shown), the mass 20*a* slides along the rod 18*a* in a direction against the bias of the spring 22*a* to compress the spring 22*a*. As this occurs, the protruding portion 102 of the mass 20*a* moves away from the tab portion 42*a* of the contact 40*a*. This allows the spring-like force of the two parallel strip portions 44*a* acting on the tab portion 42*a* to move the legs 53*a* of the contact portion 52*a* of the contact 40*a* into engagement with the surface 35*a* of the terminal 34*a*. Thus, the terminal 30*a* is electrically connected with the terminal 34*a* when the mass 20*a* is in its actuated position.

Figure 10:
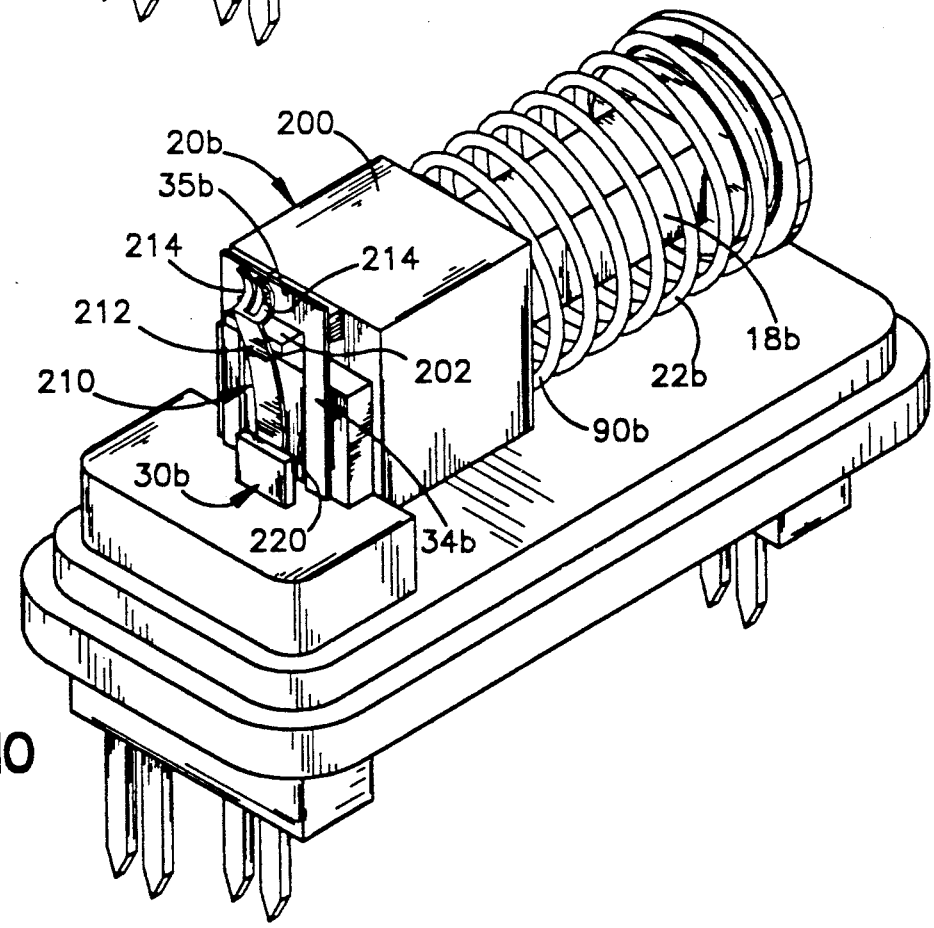
FIG. 10 is a perspective view, similar to the perspective view shown in FIG. 9, of a third embodiment of the present invention.

A third embodiment of the present invention is illustrated in FIG. 10. Since the embodiment of the invention illustrated in FIG. 10 is generally similar to the embodiment of the invention illustrated in FIG. 1, similar numerals are utilized to designate similar components, the suffix letter "*b*" being associated with the embodiment of FIG. 10 to avoid confusion.

As shown in FIG. 10, a contact 210 includes a stem portion 212 and a pair of legs 214 extending from the stem portion 212. The stem portion 212 is welded to the terminal 30*b*. The terminal 34*b* has the general shape of a horseshoe having an opening 220. In the embodiment of FIG. 10, the rod 18*b* is generally rectangular in cross section and the mass 20*b* is generally rectangular in cross section. The mass 20*b* has a rectangular-shaped central opening (not shown) which has a shape complementary to the shape of the rod 18*b* and through which the rectangular-shaped rod 18*b* extends. The one end 90*b* of the spring 22*b* is received in a cylindrical hollow (also not shown) in the mass 20*b* to support and guide the spring 22*b*.

The mass 20*b* has a main portion 200 and a protruding portion 202 which extends from the main portion 200. The protruding portion 202 of the mass 20*b* extends through the opening 220 and engages the stem portion 212 when the mass 20*b* is in its unactuated position, as shown in FIG. 10. When the protruding portion 202 engages the stem portion 212, as shown in FIG. 10, the legs 214 of the contact 210 are spaced apart from the surface 35*b* of the terminal 34*b*. Thus, the terminal 30*b* is not electrically connected with the terminal 34*b* when the mass 20*b* is in its unactuated position, as shown in FIG. 10.

When the mass 20*b* moves to its actuated position (not shown), the mass 20*b* slides along the rod 18*b* in a direction against the bias of the spring 22*b* to compress the spring 22*b*. As this occurs, the protruding portion 202 of the mass 20*b* moves away from the stem portion 212 of the contact 210. This allows the spring-like force of the stem portion 212 acting on the legs 214 to move the legs 214 into engagement with the surface 35*b* of the terminal 34*b*. Thus, the terminal 30*b* is electrically connected with the terminal 34*b* when the mass 20*b* is in its actuated position.

From the above description of the invention, those skilled in the art to which the present invention relates will perceive improvements, changes and modifications. Such improvements, changes and modifications within the skill of the art to which the present invention relates are intended to be covered by the appended claims.

Having described the invention, the following is claimed:

1. A deceleration sensor switch comprising:

a base including a plate portion, a pedestal portion projecting from said plate portion, and a rod portion spaced from said plate portion and projecting from said pedestal portion, said plate portion lying in a flat plane and said rod portion having a longitudinal central axis which extends parallel to the flat plane in which said plate portion lies, said plate, pedestal, and rod portions comprising a single continuous piece of plastic molded material;

a mass mounted on said rod portion and movable relative to said rod portion between an unactuated position and an actuated position along the longitudinal central axis of said rod portion, said mass moving from said unactuated position to said actuated position when said mass is subjected to deceleration of a predetermined magnitude;

a first electrical terminal and a second electrical terminal electrically connectable with said first electrical terminal;

means for electrically connecting said first and second electrical terminals with each other when said mass moves from said unactuated position to said actuated position; and spring means for providing a restoring force which acts on said mass to move said mass relative to said rod portion from said actuated position back to said unactuated position after said mass has moved to said actuated position.

2. A deceleration sensor switch according to claim 1 further comprising means disposed at one end of said rod portion and for enabling adjustment of the restoring force of said spring means acting on said mass.

3. A deceleration sensor switch according to claim 2 wherein said mass is mounted at an opposite end of said rod portion.

4. A deceleration sensor switch according to claim 2 wherein said means disposed at one end of said rod portion includes an adjustable calibration screw.

5. A deceleration sensor switch according to claim 1 wherein said pedestal portion projects perpendicularly away from said plate portion and said rod portion projects perpendicularly away from said pedestal portion.

6. A deceleration sensor switch according to claim I wherein said spring means includes a helical coil spring helically wound around said rod portion along its longitudinal central axis.

7. A deceleration sensor switch according to claim 1 wherein said first and second electrical terminals extend through said base and are inserted molded in said base.

8. A deceleration sensor switch according to claim 7 wherein said connecting means comprises a contact including (i) a releasable tab portion which engages said mass when said mass is in said unactuated position and which is released for movement with said mass when said mass moves from said unactuated position to said actuated position, (ii) a biasing portion which biases said tab portion into engagement with said mass, and (iii) a contact portion which is spaced apart from one of said first and second electrical terminals when said mass is in said unactuated position and which contacts said one electrical terminal when said mass is in said actuated position.

9. A deceleration sensor switch according to claim 8 wherein said one electrical terminal includes a surface and said contact portion includes at least one leg which initially contacts said surface when said mass begins to move from said unactuated position to said actuated position and then wipes across said surface as said mass continues to move to said actuated position.

10. A deceleration sensor switch according to claim 8 wherein said releasable tab portion includes an edge which presses against said mass when said mass is in said unactuated position, said edge being spaced apart from said mass when said tab portion is released and said mass is in said actuated position.

11. A deceleration sensor switch according to claim 1 further including a cover sealingly engageable with said base to seal and protect said deceleration sensor switch.

12. A deceleration sensor switch according to claim 1 wherein said first electrical terminal includes bifurcated first and second leg portions and said second electrical terminal includes bifurcated first and second leg portions.

13. A deceleration sensor switch according to claim 12 wherein said first leg portion of said first electrical terminal is connectable to a positive terminal of a voltage supply, said second leg portion of said first electrical terminal is connectable to one end of an external diagnostic resistor, said first leg portion of said second electrical terminal is connectable to the other end of the external diagnostic resistor, and said second leg portion of said second electrical terminal is connectable to a negative terminal of the voltage supply.

14. A deceleration sensor switch comprising:

a base;

a tubular rod spaced apart from said base and supported on said base, said tubular rod having a longitudinal central axis extending along its longitudinal extent;

a mass mounted on said rod and movable relative to said tubular rod between an unactuated position and an actuated position along the longitudinal central axis of said tubular rod, said mass moving from said unactuated position to said actuated position when said mass is subjected to deceleration of a predetermined magnitude;

a first electrical terminal and a second electrical terminal electrically connectable with said first electrical terminal;

means for electrically connecting said first and second electrical terminals with each other when said mass moves from said unactuated position to said actuated position;

spring means for providing a restoring force which acts on said mass to move said mass relative to said tubular rod from said actuated position back to said unactuated position after said mass has moved to said actuated position; and calibration means disposed at one end of said tubular rod and for enabling adjustment of the restoring force of said spring means acting on said mass, said calibration means including an adjustable calibration screw which can be rotated clockwise or counterclockwise to adjust the restoring force of said spring means acting on said mass.

15. A deceleration sensor switch according to claim 14 wherein said spring means includes a helical coil spring helically wound around said rod portion along its longitudinal central axis.

16. A deceleration sensor switch according to claim 14 further including a cover sealingly engageable with said base to seal and protect said deceleration sensor switch.

17. A deceleration impact sensor switch according to claim 14 wherein first and second electrical terminals extend through said base and are inserted molded in said base.

18. A deceleration sensor switch according to claim 17 wherein said connecting means comprises a contact including (i) a releasable tab portion which engages said mass when said mass is in said unactuated position and which is released for movement with said mass when said mass moves from said unactuated position to said actuated position, (ii) a biasing portion which biases said tab portion into engagement with said mass, and (iii) a contact portion which is spaced apart from one of said first and second electrical terminals when said mass is in said unactuated position and which contacts said one electrical terminal when said mass is in said actuated position.

19. A deceleration sensor switch according to claim 18 wherein said one electrical terminal includes a surface and said contact portion includes at least one leg which initially contacts said surface when said mass begins to move from said unactuated position to said actuated position and then wipes across said surface as said mass continues to move to said actuated position.

20. A deceleration sensor switch according to claim 18 wherein said releasable tab portion includes an edge which presses against said mass when said mass is in said unactuated position, said edge being spaced apart from said mass when said tab portion is released and said mass is in said actuated position.

21. A deceleration sensor switch according to claim 12 wherein said first electrical terminal includes bifurcated first and second leg portions and said second electrical terminal includes bifurcated first and second leg portions.

22. A deceleration sensor switch according to claim 21 wherein said first leg portion of said first electrical terminal is connectable to a positive terminal of a voltage supply, said second leg portion of said first electrical terminal is connectable to one end of an external diagnostic resistor, said first leg portion of said second electrical terminal is connectable to the other end of the external diagnostic resistor, and said second leg portion of said second electrical terminal is connectable to a negative terminal of the voltage supply.

* * * * *

UNITED STATES PATENT AND TRADEMARK OFFICE

CERTIFICATE OF CORRECTION

PATENT NO. : 5,306,883

DATED : April 26, 1994

INVENTOR(S) : Saroj Manandhar, Robert J. Bolender, James Purves and Long T. Su

It is certified that error appears in the above-identified patent and that said Letters Patent is hereby corrected as shown below:

Column 10, line 54, change "12" to --14--.

Signed and Sealed this

Thirteenth Day of September, 1994

*Attest:*

*Attesting Officer*

Bruce Lehman

BRUCE LEHMAN

*Commissioner of Patents and Trademarks*